United States Patent [19]

Kelly

[11] Patent Number: 4,688,361

[45] Date of Patent: Aug. 25, 1987

[54] GUM-TAPE PLATE BONDED ROOFING SYSTEM

[76] Inventor: Thomas L. Kelly, 31 Sands St., Waterbury, Conn. 06710

[21] Appl. No.: 860,045

[22] Filed: May 6, 1986

[51] Int. Cl.[4] ..... E04H 14/00

[52] U.S. Cl. ..... 52/173 R; 52/410; 52/420; 52/506

[58] Field of Search ..... 52/408, 410, 748, 173 R, 52/512, 513, 510, 515, 518, 543, 125.2, 127.3, 746, 420, 506; 156/71; 428/40, 41, 198, 201; 206/460, 813; 411/82, 258, 371–373

[56] References Cited

U.S. PATENT DOCUMENTS

| | | | |
|---|---|---|---|
| 2,030,135 | 2/1936 | Carpenter | 52/173 |
| 2,292,024 | 8/1942 | Dreher | 52/746 |
| 2,491,281 | 12/1949 | Rowe | 206/813 |
| 2,637,995 | 5/1953 | Mann | 52/232 |
| 2,705,209 | 3/1955 | Rowe | 428/41 |
| 3,121,649 | 2/1964 | Oliver | 156/71 |
| 3,135,647 | 6/1964 | Wheeley | 161/236 |
| 3,962,504 | 6/1976 | Sherwin | 52/746 |
| 4,021,981 | 5/1977 | Van Wagoner | 52/90 |
| 4,162,597 | 7/1979 | Kelly | 52/410 |
| 4,441,295 | 4/1984 | Kelly | 52/309.8 |
| 4,445,306 | 5/1984 | Schauffele | 52/410 |

FOREIGN PATENT DOCUMENTS

| | | | |
|---|---|---|---|
| 219072 | 1/1942 | Switzerland . | |
| 656328 | 8/1951 | United Kingdom | 428/41 |

*Primary Examiner*—James L. Ridgill, Jr.

*Attorney, Agent, or Firm*—Barnes & Thornburg

[57] ABSTRACT

A bonding plate and method of using same is disclosed for a single-ply membrane roofing system. The bonding plate includes a pre-applied gum tape adhesive which is covered by release paper to protect same during storage and shipping. When the plate is made of masonite or other material subject to delamination when wet, fiber scrim reinforced gum tape is used which is overlapped to a portion of the bottom of the plate for reinforcement.

20 Claims, 10 Drawing Figures

GUM-TAPE PLATE BONDED ROOFING SYSTEM

BACKGROUND AND SUMMARY OF THE INVENTION

The present invention relates to a roofing system of the type wherein a single ply roofing membrane of rubber or the like is used as the top roof layer. More specifically, the present invention is related to an improvement in such a roofing system for fastening the roof membrane in position on a roof structure.

Applicant's prior patent, U.S. Pat. No. 4,162,597, discloses and claims an insulation block and mounting means therefore which utilizes bonding pads or plates of masonite or the like disposed at the intersections of insulation boards. These bonding plates serve to hold the insulation boards in position on the roof structure. These bonding plates also serve as adhesive accommodating surfaces for holding adhesive which is then adhered to the underside of an overlying roofing membrane.

In commercial practice of the plate bonded system according to applicant's above-mentioned U.S. Pat. No. 4,162,597, EPDM rubber membrane is adhered to the bonding plates by a contact adhesive applied to both the bonding plates and the rubber membrane. This contact adhesive must first be applied to both the bonding plates and the rubber. The rubber and plates can only be adhered to one another after a certain adhesive drying time, depending upon the ambient weather conditions.

Applicant and applicant's company, Kelly Energy Systems, Inc. of Waterbury, Conn., has made and distributed a few hard masonite fiberboard bonding plates with adhesive applied by way of unreinforced gum tape strips. These unreinforced gum tape stripped bonding plates where utilized in a few mobile home roof applications. These unreinforced gum tape stripped bonding plates simplified somewhat the roof installation steps as compared to the above-mentioned contact adhesive systems where adhesive was applied to both the EPDM rubber and the masonite or plastic plates on the roof construction site.

However, since the masonite bonding plates experience delamination under certain wind load and ambient environment conditions that might occur on a roof, these unreinforced gum tape masonite installations may not perform sufficiently well in large scale commercial roof applications. For example, it is very difficult to avoid that a large scale flat commercial roof of 50,000 square feet or more will experience substantial water condensation under the rubber membrane, thus leading to potential bonding plate delamination problems with masonite bonding plates or the like. Further, in contrast to small mobile home roofs which can be covered by a single factory prepared sheet of EPDM rubber, these large commercial roofs normally require on site "field" seaming of the EPDM rubber sheets. These field seams or splices are subject to greater danger of leakage than are the factory prepared splices or seams, thereby increasing the instances of actual water leakage through the rubber roof into the space where the bonding plates are located.

The present invention is specifically directed to an improved arrangement of bonding plates for use with the system of the type disclosed and claimed in this U.S. Pat. No. 4,162,597. The present invention is also specifically directed to improved bonding plate constructions as compared to the above-noted non-reinforced gum tape stripped masonite plates.

According to the present invention, the bonding plates are provided with adhesive at their upper surfaces and this adhesive is covered by release paper. With the arrangement of the present invention, the adhesive is applied under factory controlled conditions and therefore can be applied uniformally and consistently from bonding plate to bonding plate. The installation at the roof site is simplified as compared with the prior contact adhesive arrangement since the workmen need only to remove the release paper and roll the prepared sections of rubber membrane over the top of the bonding plates. The bonding plates are mechanically attached to the underlying roof structure by screws or the like.

In certain preferred embodiments utilizing masonite bonding plates, or other bonding plates with similar delamination characteristics, the present invention contemplates the use of gum tape with scrim fiber reinforcement. These embodiments exhibit the advantages of the economically reasonable and readily available hard masonite board material with the reinforced gum tape overlapping from the top to the bottom edge of the plates to minimize the danger of rubber membrane release due to delamination of the plates.

Other preferred embodiments of the invention utilize non-delaminating material bonding plates made of materials such as Type-2 Nylon combined with two-sided adhesive gum tape that need not scrim or fabric reinforced in all cases. The Type-2 Nylon is advantageous in that it does not experience unacceptable plasticisor migration and eventual reduction in structural integrity that is expierenced by many other plastic materials. The Type-2 Nylon will not delaminate under the normal in-use ambient conditions under an EPDM roof membrane. Thus, even if these plates get wet, they will not delaminate.

The novel bonding plates of the present invention minimize the amount of adhesive that is required since there is no spillage of adhesive and the quantity of adhesive can be precisely controlled from plate to plate to be sufficient for adhering the roof mambrane in position. In especially preferred embodiments of the invention, the top surface of the bonding plates are provided with adhesive only at spaced apart strips. Since a certain minimum sized bonding plate is required on most roof installations to hold the insulation boards down and in position in the recommended patterns and since it has been determined that the entire surface of such plates need not be covered with adhesive to hold the rubber membrane, the application of adhesive in spaced apart strips optimizes the operation of the bonding plate to both hold the insulation boards in position and adhere the rubber membrane in position.

In certain preferred embodiments, the adhesive applied to the bonding plates is in the form of a two-sided gum tape, a form which is especially adaptable to the strip application of adhesive at the top surface of the bonding plate. In the masonite bond plate embodiments, the two-sided gum tape, especially fabric scrim reinforced tape, is especially advantageous in preventing delamination when placed so as to effectively overlap the plate from top to bottom.

In certain other contemplated, preferred embodiments the upper surface of the bonding plates are completely covered with preapplied adhesive. Also, embodiments with partial adhesive coverings other than strip shaped are contemplated for certain installations.

In certain preferred embodiments, the release paper for each bonding plate is formed in two separate pieces which are folded over one another along their adjoining edge so as to facilitate easy manual removal of the release paper. In order to assure that the release paper and adhesive strips stay in position on the relatively thin bonding plates during shipment and storage and in order to effectively anchor the strips to the plates and reinforce the plates against delamination, a small end portion of the adhesive strips is also extended to the bottom side of the bonding plates along the edges. In assembly on a roof structure, the release paper portions connected at the bottom of the bonding plate need not be removed and the release paper can simply be folded back away from the top surface, thus advantageously simplifying the assembly. The fastener screw or the like rigidly holds the center part of the bonding plate in position on the roof structure and the edge portions can flex upwardly during wind uplift conditions.

Further objects, features, and advantages of the present invention will become more apparent from the following description when taken with the accompanying drawings, which show for purposes of illustration only, several embodiments constructed in accordance with the present invention.

DETAILED DESCRIPTION OF THE DRAWINGS

Figure 1:
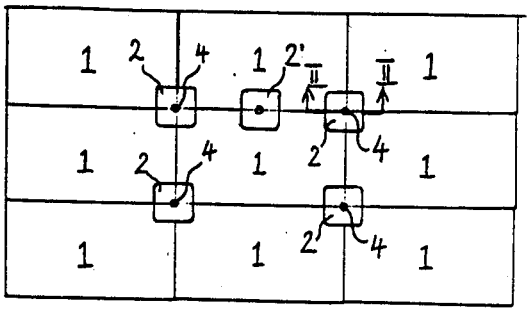
FIG. 1 is a top schematic view showing a portion of the field of a roof utilizing bonding plates constructed in accordance with the present invention.

FIG. 1 schematically depicts a portion of the field of a roof wherein the roofing system of the present invention can be utilized. It will be understood by those skilled in the art of single-ply roofing that this type of roofing construction is especially adapted for use with relatively large and flat roofs such as on schools, commercial buildings, and the like. It will also be readily understood by those skilled in the art that the details of the flashing connection of the roof membrane around protrusions such as vent pipes and chimneys, as well as the perimeter attachment details around the edges of the roof, may be constructed according to a number of readily available designs, such as those published by applicant's company, Kelly Energy Systems, Inc. of Waterbury, Conn., for its plate bonded roofing systems.

Figure 2:
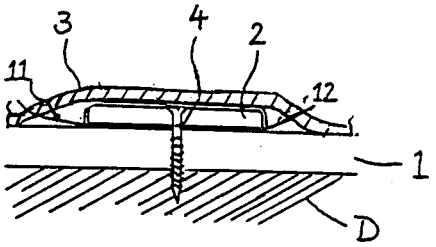
FIG. 2 is a side schematic sectional view taken along line II—II of FIG. 1, and further showing a roofing membrane attached to a bonding plate.
Figure 3:
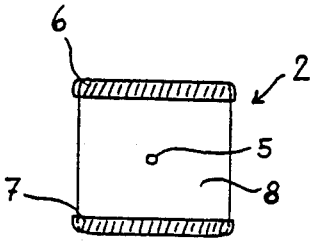
FIG. 3 is a top view of a bonding plate constructed in accordance with a preferred embodiment of the present invention, depicted without the release paper.

In FIG. 1 there is shown a plurality of insulation boards 1 abuttingly engaging one another and forming the top layer of insulation for a roof structure. In the illustrated embodiment, the insulation boards are 4×8 feet rectangular shaped boards. Bonding plates 2 are disposed at the respective intersection of four of the insulation boards 1. Additional bonding plates 2' (only one shown) are provided midway along the long edges of the insulation boards 1. The bonding plates 2 serve to hold the insulation boards 1 in position while also forming a repository for adhesive to adhere to the underside of an overlying rubber roof membrane 3 (FIG. 2). To facilitate illustration of the system, FIG. 1 does not include the rubber membrane, it being understood that a large sheet of flexible rubber membrane would extend over a large area of the roof from 20–40 feet wide and larger, these sheets being spliced at their edges by known techniques.

The bonding plates 2 are preferably formed of masonite or plastic or the like material having a thickness of about ¼ inches or less and an area dimension of approximately 1 square foot. These bonding plates 2 are fixedly held against the top side of the insulation boards 1 by means of a screw 4 through the center of the plates, which screw 4 is fastened to an underlying roof deck structure D. Washers or reinforcement around the opening 5 of the fastener 4 are preferably provided. The plates 2 (shown in exaggerated thickness in the drawings for ease of illustration) are relatively rigid or flexible so as to permit flexing of the edges of the plates during wind uplift conditions prevailing at the top of the rubber membrane attached thereto. This wind uplift responsive characteristic of these bonding plates is described in the literature of Kelly Energy Systems, Inc. of Waterbury, Conn.

Referring to FIGS. 3 to 6, an individual bonding plate constructed according to a preferred embodiment of the present invention is described as follows. The bonding plate 2 includes a pair of strips 6, 7 of gum tape extending respectively along the lateral edges of the top surface 8 of the plate 2. These gum tape strips 6, 7 are preferably 1 inch wide or slightly more, with the total length of each side of the bonding plate 2 being approximately 12 inches. Gum tape strips 6, 7 extend over the edges 9, 9' and a short distance about 1 to 2 inches along the bottom surface 10 of the plate 2. This extension of the gum tape strips over the sides 9, 9' to the bottom surface 10 facilitates the assembly of the plate and strips and assures a reliable bond between the plate and strips.

In the preferred illustrated embodiment of FIGS. 1–6, the bonding plate 2 is formed of masonite hardboard. The adhesive strips 6 and 7 are formed of two-sided scrim fiber reinforced gum tape which, because of the fiber reinforcement and the extension over to the bottom 10 of the plate 2, forms a reliable holding system for the rubber membrane 3 even though the plate might be subject to delamination because of moisture accumulation and strong wind uplift forces. In especially preferred embodiments fiber scrim reinforced gum tape is used.

Preferred embodiments are contemplated with various commercially available curable and non-curable gum tapes acceptable to roof membranes are used as the adhesive strips 6 and 7.

In other preferred embodiments, the bonding plate 2 is formed of Type-2 Nylon and the adhesive strips is non-reinforced gum tape. Since the Type-2 nylon is not subject to delamination when dampened, the extra costs for the reinforced gum tape can be saved in such installations. It is also contemplated to use Type-2 Nylon bonding plates along with scrim fiber reinforced gum tape in certain preferred embodiments.

Figure 4:
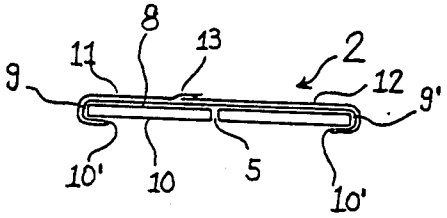
FIG. 4 is a side sectional view of the bonding plate of FIG. 3 but showing the release paper in the shipping or storage position.
Figure 4A:
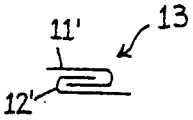

Release paper 11, 12 is provided to protect the adhesive strips 6, 7 during shipment and storage of the plates 2. As best shown in FIG. 4, the release paper pieces 10, 11 extend over the full length of the adhesive strips from the bottom surface 10 to a junction connection 13 formed at the top surface 8 of the plate 2. Junction connection 13 is formed by an edge portion 11' of paper piece 11 folded in hook shaped fashion over corresponding folded edge portion 12' of release paper piece 12.

This configuration of junction connection 13 readily accommodates a simple manual grasping of the release paper pieces 11 and 12 to expose the adhesive strips 6, 7 at the top surface 8 of the plate 2.

FIG. 2 schematically depicts the bonding plate 2 in an in-use assembled position on a roof underlying the rubber membrane 3. As can be seen from FIG. 2, the release paper pieces 11 and 12 are folded back away from the top surface of the plate 2 and remain connected along the edges 10' at the bottom side 10 of the bonding plate 2. The bonding plate is therefore free to flex upwardly at the edges relative to the underlying insulation boards 1, while retaining the firm, reliable, and consistent adhesion connection at the underside of the rubber membrane 3. In installing the bonding plates, the workers need only position the bonding plates 2 at the proper locations, pull back the release paper and attach the fastening screws. Once a series of bonding plates are in position to accept the rubber membrane, the rubber membrane is then rolled thereover to very simply and reliably attach the same in position.

Figure 5:
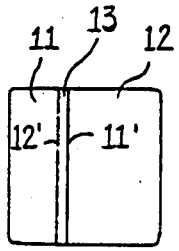
FIG. 5 is a top view of the bonding plate of FIGS. 3 and 4, with the release paper in the storage or shipping position.
Figure 6:
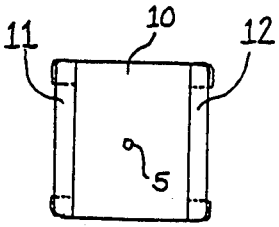
FIG. 6 is a bottom view of the bonding plate of FIGS. 3 to 5 with the release paper in the storage or shipping position.

FIGS. 5 and 6 are respective top and bottom views of the plate 2 with the release paper pieces 11 and 12 in position for storage and shipping. It is contemplated that a plurality of the plates 2 would be stacked together on top of one another for storage and shipping.

Although the preferred embodiments illustrated and described with respect to FIGS. 1–6 utilizes a 1 foot square, ¼ inch or less thick masonite plate or Type-2 Nylon plate as the bonding plate member, the invention could also be practiced utilizing other relatively rigid materials. With plate materials subject to delamination such as masonite, the scrim fiber reinforced gum tape is preferrably used.

FIGS. 7–10 schematically show different adhesive strip bonding patterns contemplated according to the preferred embodiments of the invention. In such embodiments using masonite hardboard plates, or other material subject to delamination under the adhesive moisture and load conditions which occur in many large rubber roof installations, the tape is preferrably scrim fiber reinforced gum tape and the same is extended to the bottom surface of the bonding plate similarly as described above for the embodiment of FIGS. 1–6.

Figure 7:
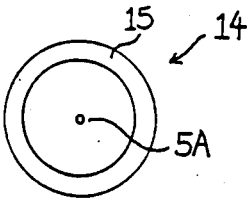
FIG. 7 is a top view of another preferred embodiment of a bonding plate constructed in accordance with the present invention, in the form of a circular bonding plate with a donut-shaped adhesive applied thereto.

In FIG. 7, a round bonding plate 14 of approximately one foot diameter is provided with a donut-shaped unitary strip of the two-sided gum tape 15 around the periphery. Hole 5A accommodates a fastener screw. The strip 15 is at least 1" wide.

Figure 8:
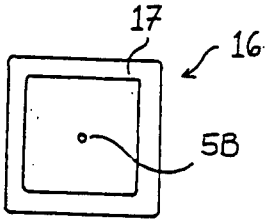
FIG. 8 is a top view of another preferred embodiment of a bonding plate constructed in accordance with the present invention, in the form of a square bonding plate with unitary square donut strip of adhesive along all four side edges.

In FIG. 8, a one foot square bonding plate 16 is provided with a donut-like unitary strip of the two-sided gum tape 17 around the periphery. Hole 5B accommodates a fastener.

Figure 9:
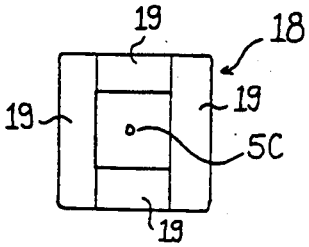
FIG. 9 is a top view of another preferred embodiment of a bonding plate constructed in accordance with the present invention, in the form of a square bonding plate with multiple strips of adhesive along all four side edges.

In FIG. 9, a pattern of separate gum tape strips 19 are disposed on a square bonding plate 18. Hole 5C accommodates a fastener.

Figure 10:
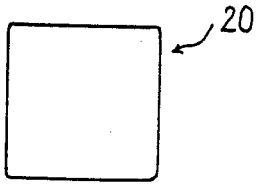
FIG. 10 is a top view of another preferred embodiment of a bonding plate constructed in accordance with the present invention, in the form of a square plate with the top surface covered completely with adhesive.

In FIG. 10, the entire top surface of the bonding plate 20 is covered with adhesive gum tape material.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed:

1. Bonding plate for a roofing of the type having a single-ply roof membrane of rubber or the like overlying and adhesively attached to a plurality of spaced apart bonding plates that are anchored to a roof support structure by mechanical fastening means, said bonding plate comprising:

a relatively rigid plate body member having oppositely facing top and bottom surfaces, adhesive applied to at least a portion of the top surface of the plate body member, and removable release film means covering the adhesive accomodating storage and shipping of the bonding plate, wherein said plate body member is made of masonite hardboard or the like material which is subject to delamination when subjected to moisture, and wherein said adhesive is in the form of two-sided fabric scrim reinforced gum tape, said gum tape extending from the plate top surface over the edge and along at least a portion of the plate bottom surface.

2. Bonding plate according to claim 1, wherein said plate body member is less than ¼ thick and includes a center hole for accommodating a mechanical fastening means in the form of a screw or the like.

3. Bonding plate according to claim 1, wherein said plate body member is square with rounded corners, said square being between 6" and 15" on each side.

4. Bonding plate according to claim 3, wherein said square is between 10" and 12" on each side.

5. Bonding plate according to claim 1, wherein said adhesive is applied to less than 50% of the area of the top surface.

6. Bonding plate according to claim 5, wherein said adhesive is applied to between 25% and 50% of the area of the top surface.

7. Bonding plate according to claim 1, wherein the release film means extends over edge portions of the plate body member and covers the adhesive at both the top and bottom surfaces.

8. Bonding plate according to claim 7, wherein said release film means is formed of a plurality of release paper pieces which are folded over one another at a connection location on the top surface of the plate body member to permit manual removal thereof by grasping of the folded over portions.

9. Bonding plate according to claim 1, wherein said adhesive is disposed in spaced apart strips over the top surface of the plate body member.

10. Bonding plate according to claim 9, wherein said plate body member is rectangular in shape, and wherein said strips include strips immediately adjacent respective opposite lateral edges of the plate body member.

11. Bonding plate according to claim 10, wherein the release film means extends over edge portions of the plate body member and covers the adhesive at both the top and bottom surfaces.

12. Bonding plate according to claim 11, wherein said release film means is formed of a plurality of release paper pieces which are folded over one another at a connection location on the top surface of the plate body member to permit manual removal thereof by grasping of the folded over portions.

13. Bonding plate in a roofing of the type having a single-ply roof membrane of rubber or the like overlying and adhesively attached to a plurality of spaced apart bonding plates that are anchored to a roof support structure by mechanical fastening means, said bonding plate comprising:

a relatively rigid plate body member having oppositely facing top and bottom surfaces, adhesive applied to at least a portion of the top surface of the plate body member, and removable release film means covering the adhesive accomodating storage and shipping of the bonding plate, wherein said plate body member is formed of a non-delaminating plastic material.

14. Bonding plate according to claim 13, wherein said adhesive is applied to between 25% and 50% of the area of the top surface.

15. Bonding plate for a roofing of the type having a single-ply roof membrane of rubber or the like overlying and adhesively attached to a plurality of spaced apart bonding plates that are anchored to a roof support structure by mechanical fastening means, said bonding plate comprising:

a relatively rigid plate body member having oppositely facing top and bottom surfaces, adhesive applied to at least a portion of the top surface of the plate body member, and removable release film means covering the adhesive accomodating and shipping of the bonding plate, wherein said plate body member is formed of a non-delaminating plastic material, and wherein said plate body member is formed of Type-2 Nylon and said adhesive is non-reinforced two-sided gum tape.

16. Bonding plate according to claim 15, wherein the release film means extends over edge portions of the plate body member and covers the adhesive at both the top and bottom surfaces.

17. Bonding plate according to claim 16, wherein said release film means is formed of a plurality of release paper pieces which are folded over one another at a connection location on the top surface of the plate body member to permit manual removal thereof by grasping of the folded over portions.

18. A roofing installation method for a roofing of the type having a single ply roof membrane of rubber or the like overlying and adhesively attached to a plurality of spaced apart bonding plates that are anchored to a roof support structure by mechanical fastening means, said method comprising:

placing a plurality of bonding plates at spaced apart locations on a roof structure to be covered, said bonding plates including a top surface at least partly covered with adhesive and removable release film means protectively covering the adhesive, manually removing the release film means, mechanically fastening the bonding plates to the roof structure, and applying the roof membrane over the top of the bonding plates to be adhered thereto at the adhesive thereon, wherein said plate body member is made of masonite hardboard or the like material which is subject to delamination when subjected to moisture, and wherein said adhesive is in the form of two-sided fabric scrim reinforced gum tape, said gum tape extending from the plate top surface over the edge and along at least a portion of the plate bottom surface.

19. A method according to claim 18, wherein said release film means includes two release paper pieces at each bonding plate, said two release paper pieces being overlapped and folded together along the top surface of the bonding plate, and wherein said removing of the release film means includes manually grasping the two release paper pieces at said folded portion.

20. A method according to claim 19, wherein said removing of the release paper means and mechanically fastening the bonding plates is done while leaving edges of the release film means adhered to adhesive at portions of the bottom surface of the bonding plate.

* * * * *